United States Patent [19]

Larin

[11] Patent Number: 4,597,146

[45] Date of Patent: Jul. 1, 1986

[54] METHOD OF MAKING BADGES OR EMBLEMS

[76] Inventor: Leo H. Larin, 5314 Colonade Ct., Cape Coral, Fla. 33904

[21] Appl. No.: 575,003

[22] Filed: Jan. 30, 1984

[51] Int. Cl.[4] ..... A44C 3/00; A44C 27/00

[52] U.S. Cl. ..... 29/160.6; 29/527.3; 40/1.5; 428/573; 427/271; 427/275; 63/20

[58] Field of Search ..... 427/7, 145, 261, 274, 427/405; 428/13, 14.29, 67, 542.2, 913.3, 573, 601, 645, 646, 650; 40/1.5, 10 D, 324; 63/20, DIG. 3; 156/242; 264/74, 271.1, 132; 29/160.6

[56] References Cited

U.S. PATENT DOCUMENTS

| | | | |
|---|---|---|---|
| 550,395 | 11/1895 | McRae | 40/1.5 |
| 3,212,204 | 10/1965 | Smith | 40/1.5 |
| 3,412,575 | 11/1968 | Feldman et al. | 63/20 |
| 3,659,327 | 5/1972 | Beverick et al. | 29/160.6 |
| 4,254,544 | 3/1981 | Barker | 29/160.6 X |
| 4,297,405 | 10/1981 | Kasahara et al. | 427/264 X |

*Primary Examiner*—Joseph L. Schofer

*Assistant Examiner*—F. M. Teskin

*Attorney, Agent, or Firm*—Alfred E. Wilson

[57] ABSTRACT

An improved method of making lead or tin based alloy badges or emblems having brilliantly colored closely spaced cloisonned areas into which the desired colors can be introduced. The cloisonned areas separate the differently colored sections from each other by the formation of slight ridges or low fences into which the differently colored paints can be introduced. After the differently colored paints or other colorings have been introduced into the cloisonned areas and dried, the badge or emblem is polished to expose the ridges or fences separating the cloisonned areas and any other raised areas which it is desired to emphasize. The badge or emblem is then plated with an appropriate plating to cover the raised cloisonned areas and any other raised areas which it is desired to highlight. The resulting badges or emblems have clearly defined brilliantly colored sections and embody remarkable detailed structures.

1 Claim, 7 Drawing Figures

METHOD OF MAKING BADGES OR EMBLEMS

BACKGROUND OF THE INVENTION

Heretofore badges and emblems have been made by applying the desired plating to the badges or emblems, and then applying vitreous enamel or other suitable coloring to the plated surfaces. As a result the coloring does not penetrate through the plating to such a degree as to insure brilliant and long lasting coloring, and it has not been possible to insure clear demarcation of different colors when they are applied to closely adjacent areas of the badges or emblems.

FIELD OF THE INVENTION

This invention is an improvement over the heretofore practiced processes by applying the desired coloring to the relatively porous lead or tin based alloy whereupon the coloring is absorbed into the body of the badge or emblem, and the plating is thereafter applied to clearly define the small ridges or fences between the cloisonned areas into which the different colors are introduced.

DESCRIPTION OF THE PRIOR ART

In the prior art badges or emblems are cast in any suitable alloy or metal, and after suitable cleaning and polishing they are plated with whatever plating material is desired. The coloring is then applied, but after the plating process the pores of the badges are virtually sealed so that as a result the coloring does not penetrate into the body of the badge or emblem, and as a result the coloring is subject to being worn off rather easily as the surface of the badge or emblem comes in contact with clothing or other articles.

SUMMARY OF THE INVENTION

This process overcomes the shortcomings of the processes heretofore used in the making of brilliantly colored badges and emblems because the various areas to which different colors are to be applied are separated by the low ridges or fences of the cloisonned structure for separating the adjacent areas into which different coloring is to be applied. This permits the coloring of the various areas to be segregated and the coloring is permitted to penetrate into the pores of the alloy badges or emblems to insure a deep-seated coloring into the body of the badge or emblem beyond the outer surfaces of the badges or emblems to insure long lasting brilliant coloring.

The plating applied after the application of the coloring to the badges or emblems is applied to the ridges or fences separating the cloisonned areas to emphasize the separation of the differently colored areas. The plating does not penetrate to any substantial degree in the colored areas which therefore remain brilliant due to the penetration of the coloring into the pores of the badges or emblems. The plating applied to the low ridges or fences and any raised areas to be highlighted emphasizes the separation of the colored areas and cooperates in the distinctive overall appearance of the badge or emblem.

DESCRIPTION OF THE PREFERRED EMBODIMENT

Figure 1:
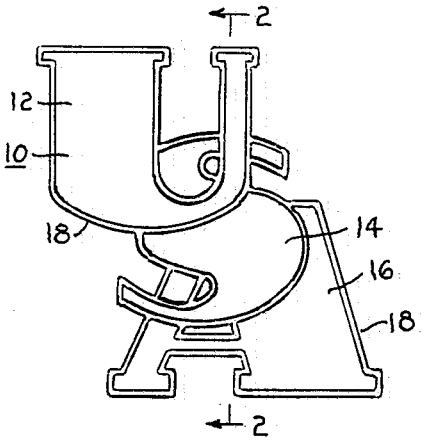
FIG. 1 is a plan view of the master model of the desired badge or emblem to be formed.
Figure 2:
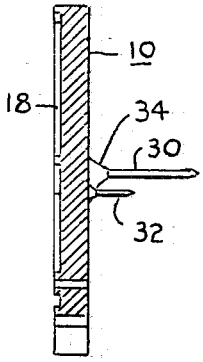
FIG. 2 is a sectional view taken substantially on the line 2—2 of FIG. 1 looking in the direction of the arrows.
Figure 3:
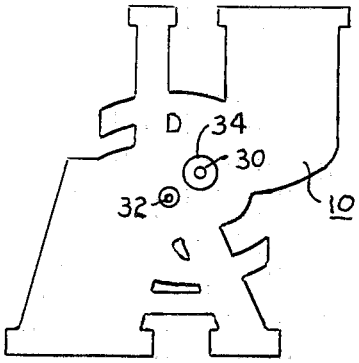
FIG. 3 is plan view of the reverse side of the emblem illustrated in FIGS. 1 and 2.
Figure 4:
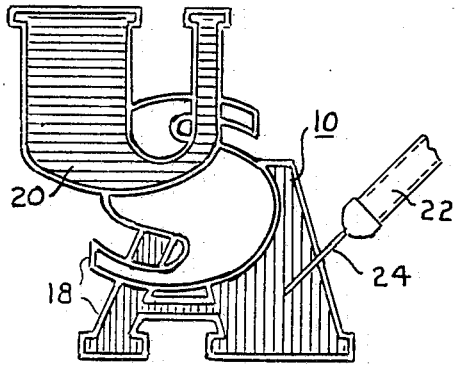
FIGS. 4 to 7 are front plan views of the reproductions of the master model having cloisonned areas with slight ridges or low fences bonding each of the areas which it is desired to be colored with different colors, and illustrating different steps in the formation of the colored specimens.
Figure 5:
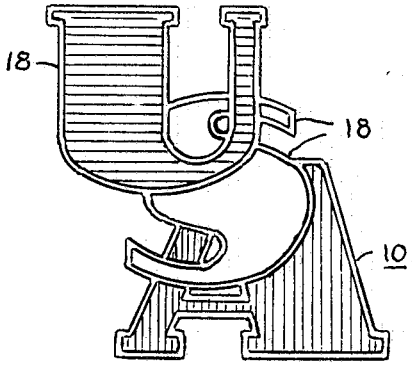
Figure 6:
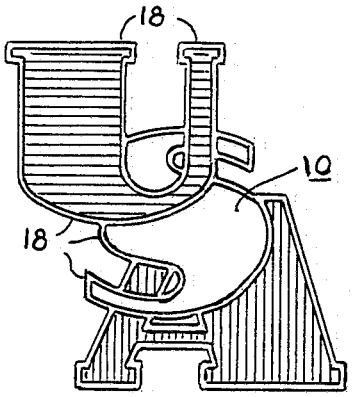
Figure 7:
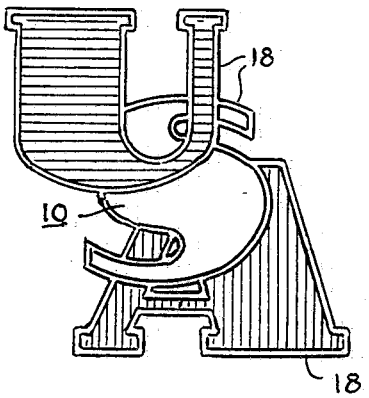

An improved method of making brilliantly colored badges and emblems starts with the making of a master model 10 of the badge or emblem desired as shown in FIGS. 1 to 3. This master model 10 can be made in any desired manner as by the use of a pantograph machine or by the use of any desired tooling. The master model 10 is cloisonned, meaning that the adjacent areas such as 12, 14 and 16 which are to be painted with differently colored paints or other coloring are separated by slight ridges or low fences 18 bounding each of the areas which are to be painted different colors. These cloisonned ridges 18 are very low of the order of only a few thousandths of an inch, yet sufficient to entrap and confine the quantity of paint necessary to thoroughly cover that particular cloisonned area when the badge or emblem is positioned horizontally.

The master model 10 is preferably made of a relatively soft alloy such as a combination of lead and tin, such for example as 70% tin and 30% lead so as to be readily workable and yet be stable.

When a satisfactory cloisonned master model 10 has been prepared provisions are made to reproduce a desired number of reproductions thereof corresponding with the number of badges or emblems to be produced. This can be achieved in various ways, for example by the formation of a rubber mold which may be installed in a centrifugal casting machine to insure the formation of homogeneous and solid specimens 20 of the badges or emblems desired. These specimens can be formed of aluminum, zinc, tin, lead or any suitable combination of those alloys to produce pewter, linotype, electrotype lead, white metal or other suitable alloy having a low melting temperature.

The specimens 20 thus formed are trimmed and then cleaned as for example in a tumbling machine, and they are washed and dried. The desired coloring such for example as blue, white and red is then applied in each of the cloisonned areas 12, 14, and 16, respectively, with the badges or emblems being positioned in a horizontal position.

While any suitable coloring material can be employed, I have found that epoxy paint is particularly desirable. To apply the correct quantity of paint to small cloisonned areas such as 12, 14 and 16 for example, syringes 22 with small needles 24 can be employed to insure discharging the desired quantity of paint. The surfaces of the cast alloy specimens 20 have minutely porous surfaces into which the epoxy paint penetrates to provide long lasting brilliant painted surfaces.

The specimens are then dried, preferably by baking them at temperatures ranging from approximately 225° F. to 250° F. for a period ranging from two to four hours. After the drying operation the specimens are polished, preferably using felt and cotton wheels and pumice powder to clean the cloisonned ridges 18 and any other raised areas which it is desired to plate to impart information such for example as a trademark or other name, or an address, telephone number or other identifying data.

Any desired plating may be employed including copper, nickel, silver, gold or other suitable plating material. The resulting badges or emblems have bright finishes, smooth surfaces and vivid colors which far surpass the appearance and detailed construction of badges or emblems painted with vitreous enamel.

The cloisonned areas are molded under pressure in the lead, tin and zinc alloys to produce alloys commonly referred to as pewter, linotype and white metal or other suitable alloy having a low melting temperature. These alloys have minutely porous surfaces into which the paint penetrates to provide a painted thickness of substantial depth. The small cloisonned ridges 18 keep the paint from flowing out of the areas where a particular paint is supposed to be and therefore insure clear uncontaminated emblems, badges, etc.

As shown in FIGS. 2 and 3 the reference numeral 30 illustrates an attaching pin added to the back of the badge or emblem by which the badge or emblem can be secured to an article of clothing. The reference numberal 32 illustrates a restraining pin, also secured to the back of the badge or emblem to project into an article of clothing to which the badge or emblem is attached to prevent the badge or emblem from rotating on the attaching pin 30 so as to assume an angle such that the printing or other message on the badge or emblem would not be positioned at the proper angle to render it properly readable. Also the conical build up around the point of contact of the attaching pin 30 with the emblem or badge is to strenghten or support the attaching pin, and to cushion the contact of the pin 30 with the clothing of a wearer of the emblem or badge.

I claim:

1. The method of making non-transparent colored badges or emblems having front and back surfaces which comprises the steps of making a cloisonned master model of the badge or emblem having low ridges on the front surface only to confine paint to the cloisonned areas bounded by the low ridges when the badges or emblems are positioned in a horizontal position and paint is applied to the cloisonned areas, forming a plurality of specimens of the master model by a casting process, trimming and polishing the specimens, applying paint to the cloisonned areas on the front surfaces of the specimens, drying the paint, polishing the specimens to clean the cloisonned ridges, and thereafter plating the badge or emblem with a suitable plating material to cover the cloisonned ridges on the front surface only of the specimens.

* * * * *